US007082648B2

(12) United States Patent
Morioka et al.

(10) Patent No.: US 7,082,648 B2
(45) Date of Patent: Aug. 1, 2006

(54) AIR/WATER-TIGHT SLIDE FASTENER

(75) Inventors: Koitsu Morioka, Kurobe (JP); Nobuhiro Ichikawa, Namerikawa (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/823,287

(22) Filed: Apr. 13, 2004

(65) Prior Publication Data

US 2004/0211041 A1 Oct. 28, 2004

(30) Foreign Application Priority Data

Apr. 25, 2003 (JP) ..... 2003-121588

(51) Int. Cl.
*A44B 19/36* (2006.01)

(52) U.S. Cl. ..... 24/389; 24/435

(58) Field of Classification Search ..... 24/389, 24/384, 433–436, 387, 388
See application file for complete search history.

(56) References Cited

U.S. PATENT DOCUMENTS 2,496,878 A * 2/1950 Krupp ..... 24/389
3,869,765 A * 3/1975 Fukuroi ..... 24/435
3,895,418 A * 7/1975 Ebata ..... 24/435
4,658,480 A * 4/1987 Morioka et al. ..... 24/389
4,780,937 A * 11/1988 Kusayama ..... 24/389
4,782,563 A * 11/1988 Kusayama ..... 24/435
4,817,252 A * 4/1989 Kusayama ..... 24/389
6,609,863 B1 * 8/2003 Morioka et al. ..... 410/68

FOREIGN PATENT DOCUMENTS

JP 4-36657 8/1992

* cited by examiner

*Primary Examiner*—James R. Brittain
(74) *Attorney, Agent, or Firm*—Everest Intellectual Property Law Group; Michael S. Leonard

(57) ABSTRACT

An air/water-tight slide fastener has an end stop. The end stop has a flange portion extending therearoud. At least part of the flange is extensive enough to be integrally fixed to the opening edges of an opening formed in an article. Since the flange portion is firmly clamped by and between the air/water-tight fastener tape and the opening edges of the opening of the article; when the air/water-tight slide fastener is folded on itself; the excessive bending stresses exerted directly on the air/water-tight fastener tape is relaxed or mitigated. The air/water-tight fastener tape is thus prevented from being peeled off at that position.

6 Claims, 9 Drawing Sheets

AIR/WATER-TIGHT SLIDE FASTENER

CROSS-REFERENCE TO RELATED APPLICATIONS

The entire disclosures of Japanese patent application number 2003-121588 filed on Apr. 25, 2003 are incorporated herein by reference in their entirety.

BACKGROUND OF THE INVENTION

1. Filed of Invention

The present invention relates to an air/water-tight slide fastener used for a flexible container for transportation of liquid, protective clothes, diving suits, and the like, and particularly to an air/water-tight slide fastener wherein end stops are firmly attached thereto and reliable air/water-tightness can be enjoyed.

2. Description of the Related Art

Strict air/water tightness is required for a flexible container for transpiration of liquid, protective clothes, diving suits, undersea tunnel and the like articles which are subjected to high pressure. Air/water-tight slide fasteners comprised of an air/water-tight slide fastener chain, a slider and end stops are much used for these fields. One example of air/water-tight slide fasteners of this type is disclosed in Japanese Utility Model Publication No. 4-36657 filed by the applicant of this patent application.

A fastener element of this conventional slide fastener is comprised of an arrow-shaped coupling element having a coupling head formed on its one end and a substantially U-shaped clamping element. One longitudinal edge of the air/water-tight fastener tape is folded thereon in Ω shape and wrapped around a flange of the coupling element. The longitudinal edge wrapped around the flange of the coupling element is then firmly clamped by the clamping element from both front and rear side of the air/water-tight fastener tape. A plurality of fastener elements are attached to the longitudinal edge of the air/water-tight fastener tape at a predetermined interval, so that an air/water-tight fastener stringer is produced.

A backing patch is integrally attached to one end of the air/water-tight fastener tapes. A slider is introduced into a pair of fastener stringers having a predetermined length. An upper and lower end stops are integrally formed by injection molding process to an upper and lower ends, respectively, of the fastener stringers, to thus provide the air/water-tight slide fastener. Each of these upper and lower end stops is comprised of substantially parallelepiped blocks. The block has a narrow flange portion or fin integrally formed therearound. The flange portion is welded to both the fastener tape and the backing patch across the boundary therebetween.

The air/water-tight slide fastener thus produced is attached all around the periphery of, for example, a flexible container except a little part of the periphery in order to open and close the container. The opening edges of the opening formed in the flexible container are attached to the air/water-tight tapes and the backing patch through high-frequency welding or supersonic welding, spaced a predetermined distance outwardly from the position where the flange portions of the upper and lower end stops and the slider are located.

This type of water/air-tight slide fastener is intended to be attached to an article such as a collapsible flexible container used for containing certain liquid in transporting it with a track or a freight car exclusively used for that purpose. After the track or the freight car reaches the destination, the liquid is shifted from the collapsible containers to other containers. The collapsible container is collapsed when out of use. Most of liquid that is transported with the collapsible containers is drinking water or various beverage and the collapsible containers must be kept clean at all times. Whenever transportation may finish, the collapsible containers must undergo the steps of cleansing, sterilization and drying. In these steps, the air/water tight tape of the slide fastener attached to the container is also liable to be folded around the end stops.

FIG. 9 shows how the conventional air/water-tight slide fastener is folded. FIG. 9 is a perspective view of an essential part of the slide fastener as viewed from the side opposite to the side where the slide fastener is folded. A common end stop 114 of the fastener stinger 117 is comprised of a block 114*a* and a narrow fin or flange portion 114*b* integrally formed around the block 114*b* and extending outwardly therefrom. As shown in FIG. 9, when the slide fastener is folded around the end stop 114, the air/water-tight tape 111 is abruptly folded longitudinally thereof on the boundary between the block 114*a* and the flange portion 114*b* of the end stop 114. At this moment, part of the air/water-tight tape 111 is liable to be peeled off the flange portion 114*b*, so that the air-tightness is lost, which is fatal to this type of air/water-tight slide fastener Specifically, when the flexible container 30 is folded, unexpected severe stress is exerted upon the flexible container 30, tending to turn or bend the air/water-tight fastener tapes 111 attached to the flexible container 30 along the boundary between the block 114*a* and the flange portion 114*b* of the end stop 114, whereon the flange portion 114*b* is forced to restore into the original unfolded disposition due to its resiliency and at the same time that part 111*a* of the air/water-tight tapes 111 which lies along the lower edge of the flange portion 114*b* is subjected to direct and strong bending stresses against the resiliency of the flange portion 114*b*. Consequently, the air/water-tight tape part 111*a* gets peeled off from the flange portion 114*b*. This peel-off phenomenon of the air/water-tight tape 111 would destroy or derogate from the air/water-tightness which is an essential function of the air/water-tight slide fastener 110.

The conventional air/water-tight slide fastener disclosed in the above-mentioned utility model publication is often attached to the opening of the flexible container so as to open and close the container. This air/water-tight slide fastener is repeatedly subjected to severe stresses when the container is folded and unfolded during laundering, sterilization and drying thereof. Even if the peeled-off portion is small, as bending stresses are repeatedly exerted upon that part of the air/water-tight tape that lies along the lower edge of the flange portion of the end stop, the peeled-off portion grows bigger and bigger, and eventually the slide fastener loses air/water-tightness and water leakage occurs therethrough. This is a problem with the conventional air/water-tight slide fastener.

Furthermore, portable sports gears such as diving suits to which such air/water-tight slide fastener is attached are collapsed and sometimes placed on a floor when out of use, and these sports gears are sometimes trampled down. That part of the air/water-tight tapes which lies along the lower edge of the flange portion of the end stop is subject to direct and strong bending stresses, which leads to deterioration of air/water-tightness.

This invention is intended to overcome the above problem. Specifically, a purpose of the present invention is to provide this type of air/water-tight slide fastener which keeps air/water-tight and durable for a long period of time, and which would not suffer from the peeled-off phenomenon, even if it were forcibly folded longitudinally thereof.

SUMMARY

In accordance with the present invention, an air/water-tight slide fastener for opening and closing an opening formed in an article comprises a pair of fastener stringers each including an air/water-tight tape and a plurality of fastener elements mounted on one longitudinal edge thereof. Each fastener element includes a coupling element having a shaft and a coupling head provided on one end of the shaft, and a substantially U-shaped clamping element. The shaft is wrapped by the longitudinal edge of the tape with the coupling head projecting outwardly from the longitudinal edge of the tape, and then clamped by the U-shaped clamping element with the wrapping longitudinal tape edge interposed therebetween. The fastener tapes are mounted along the opposed edges of an opening on the rear side of the article. The air/water-tight slide fastener further includes a slider reciprocally movable along the fastener elements around the clamping elements to bring the coupling elements into and out of engagement with each other; and an end stop integrally mounted on one end of the fastener stringers to stop the movement of the slider. The end stop includes a block and a flange portion extending around the block and intimately fixed to the front side of the air/water-tight tape. At least part of the flange portion is extensive enough to be integrally fixed to the opening edges of the article.

A conventional air/water-tight slide fastener with commonplace constructions suffers from the following drawbacks. When such a slide fastener is folded along the length of its air/water-tight fastener tape, the air/water-tight fastener tape tends to turn or bend on the boundary between the block and the flange portion of the end stop, and that part of the fastener tape which lies in the lower edge of the flange portion tends to abruptly bend towards the length of the fastener tape. At this moment, that part of the slide fastener which lies in thee lower edge of the flange portion is subjected to strong bending stresses. For that reason, when folded, the air/water-tight fastener tape is subjected to direct excessive stresses and is thus peeled off In view of this, the air/water-tight slide fastener according to the present invention is of the construction in which at least part of the flange portion is extensive enough to being integrally fixed to the edges of the opening of the article to which the slide fastener is attached. The area over which the flange portion is attached to the air/water-tight tape is increased and hence the strength by which the flange portion is attached to the air/water-tight tape is increased as well. The edges of the opening formed in the article are integrally attached to the front surface of the flange portion and the air/water-tight fastener tape, so that the air/water-tight fastener tape is attached to the flange portion more strongly.

When the air/water tight slide fastener according to the present invention is folded, the edge of the flange portion rotates on the boundary between the block and the flange portion of the end stop so as to be separated from the block, just as the conventional device. Partly because part of the lower edge of the flange portion is firmly clamped by and between the air/water-tight fastener tape and the edges of the opening formed in the article, and partly because the air/water tight fastener tape and the article are integrally attached to the edges of the flange portion, the flange portion is prevented by the edges of the opening of the article from springing back, thus alleviating the excessive bending stress to which the air/water-tight fastener tape would be otherwise subjected. As a result, the air/water-tight fastener tape is efficiently prevented from being peeled off.

Preferably, the flange portion may be made of flexible materials. The end stop is integrally formed with the air/water-tight fastener tape through injection-molding process. Therefore, the end stop may be preferably made of elastic thermoplastic resin of the same type as the material of the air/water-tight fastener tape. Most preferably, the end stop may be made of soft polyurethane resin, although the materials should not be limited to this. The above-mentioned construction helps the end stop gently bend around the boundary between the block and the flange portion of the end stop. The bending stress exerted on the flange portion is thus distributed, so that excessive bending stress is prevented from directly and locally works upon the air/water-tight fastener tape. As a result, the durability and the attachment strength of the air/water-tight fastener tape are enhanced further.

The position of the flange portion may be selected suitably, depending on the length and width of the air/water-tight slide fastener, the materials of the air/water-tight fastener tapes, the size of the clamping elements, the shape, size, construction and material of the end stop, so as to ensure that, when the air/water-tight slide fastener is folded longitudinally thereof, the air/water-tight fastener tape can be efficiently prevented from being partially peeled off the lower edge of the flange portion of the end stop.

The maximum width of the slider is set to be less than the opening width defined by and between the opening edges. If the maximum width W1 of the slider is too close to the opening width W2 between the opposed edges of the opening of the article, it naturally follows that the opposed edges of the opening of the article attached to the front surface of the flange portion are arranged closer to the fastener element rows. Manipulating the slider in this disposition would cause part of the air/water-tight fastener tape (which must elastically deform) become stiff, which disadvantageously precludes smooth coupling and decoupling of the fastener elements. If the flange portion of the end stop, the air/water-tight fastener tape and the article are integrally joined together under the relation of the maximum width W1 of the slider being less than the opening width W2 between the opposed edges of the opening of the article, the slider can be manipulated smoothly and at great ease.

DESCRIPTION OF THE DRAWINGS

Preferred embodiments of the present invention will now be described by way of example only and with reference to the accompanying drawings, in which.

DETAILED DESCRIPTION OF THE INVENTION

Figure 1:
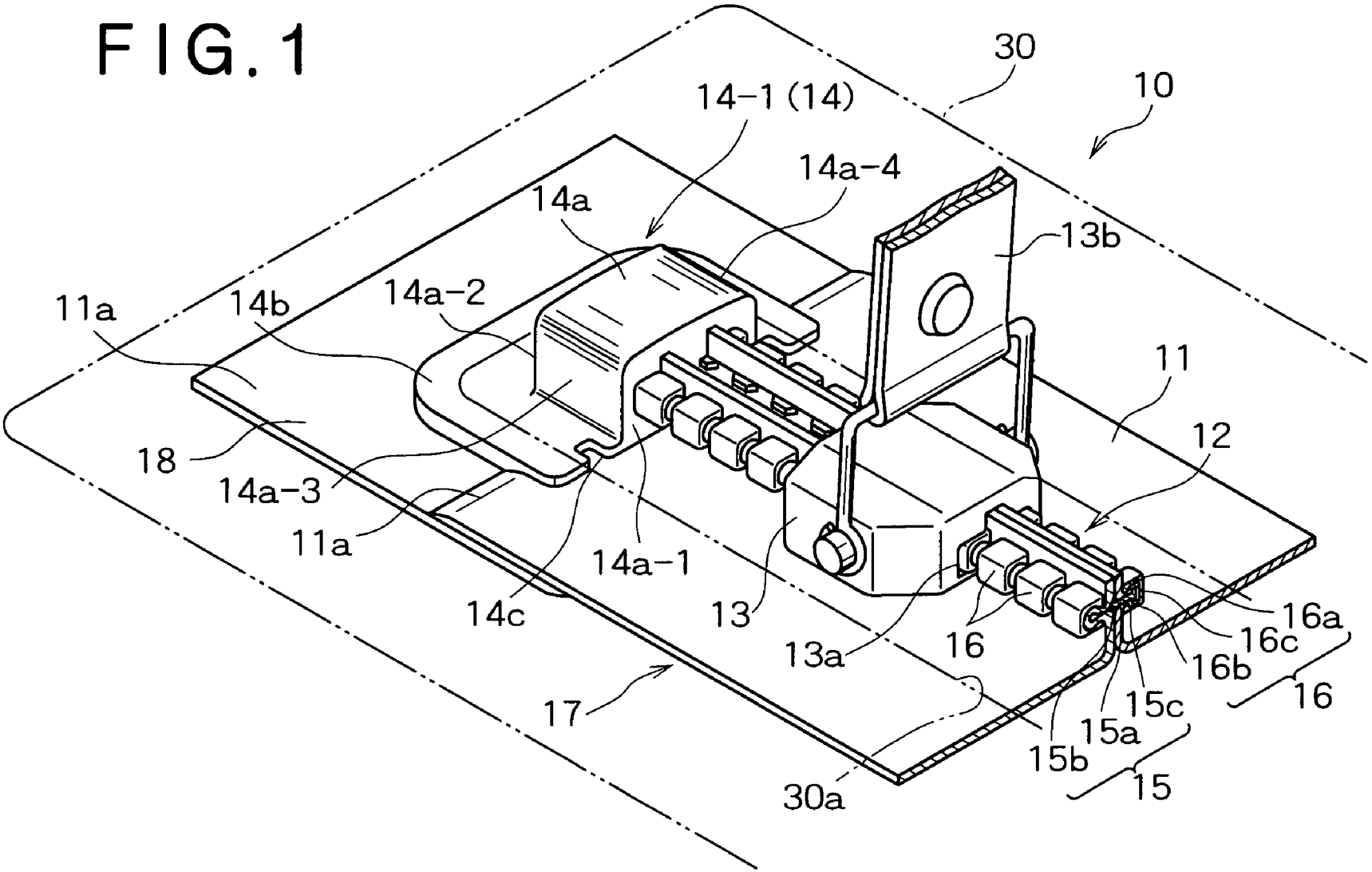
FIG. 1 is a perspective view of an upper end stop for an air/water-tight slide fastener according to an embodiment of the present invention.

The following provides a list of the reference characters used in the drawings:

| | |
|---|---|
| 10, 110 | Water-tight slide fastener |
| 11, 111 | Air/water-tight fastener tape |
| 11, 111a | Part of fastener tape |
| 11b | Ω-shaped element-retaining portion |
| 12 | Fastener element |
| 13 | Slider |
| 13a | Inlet of Y-shaped channel |
| 13b | Pull tab |
| 14, 114 | End stop |
| 14-1 | Upper end stop |
| 14-2 | Lower end stop |
| 14a, 114a | Block |
| 14a-1~4 | Side |
| 14b, 114b | Flange portion |
| 14c | Cut out portion |
| 15 | Coupling element |
| 15a | Rectangular shaft |
| 15b | Coupling head |
| 15c | Rectangular flange |
| 16 | Clamping element |
| 16a. 16b | Clamping arms |
| 16c | Connecting portion |
| 17, 117 | Fastener stringers |
| 18, 118 | Backing patch |
| 30 | Article |
| 30a | Opening edge |

Detailed description of preferred embodiments of the present invention will be made in conjunction with the drawings appended hereto. FIG. 1 is a perspective view showing an upper end stop for an air/water-tight slide fastener acceding to an embodiments of the present invention, and FIG. 2 is a perspective view showing a lower end stop therefor.

Figure 2:
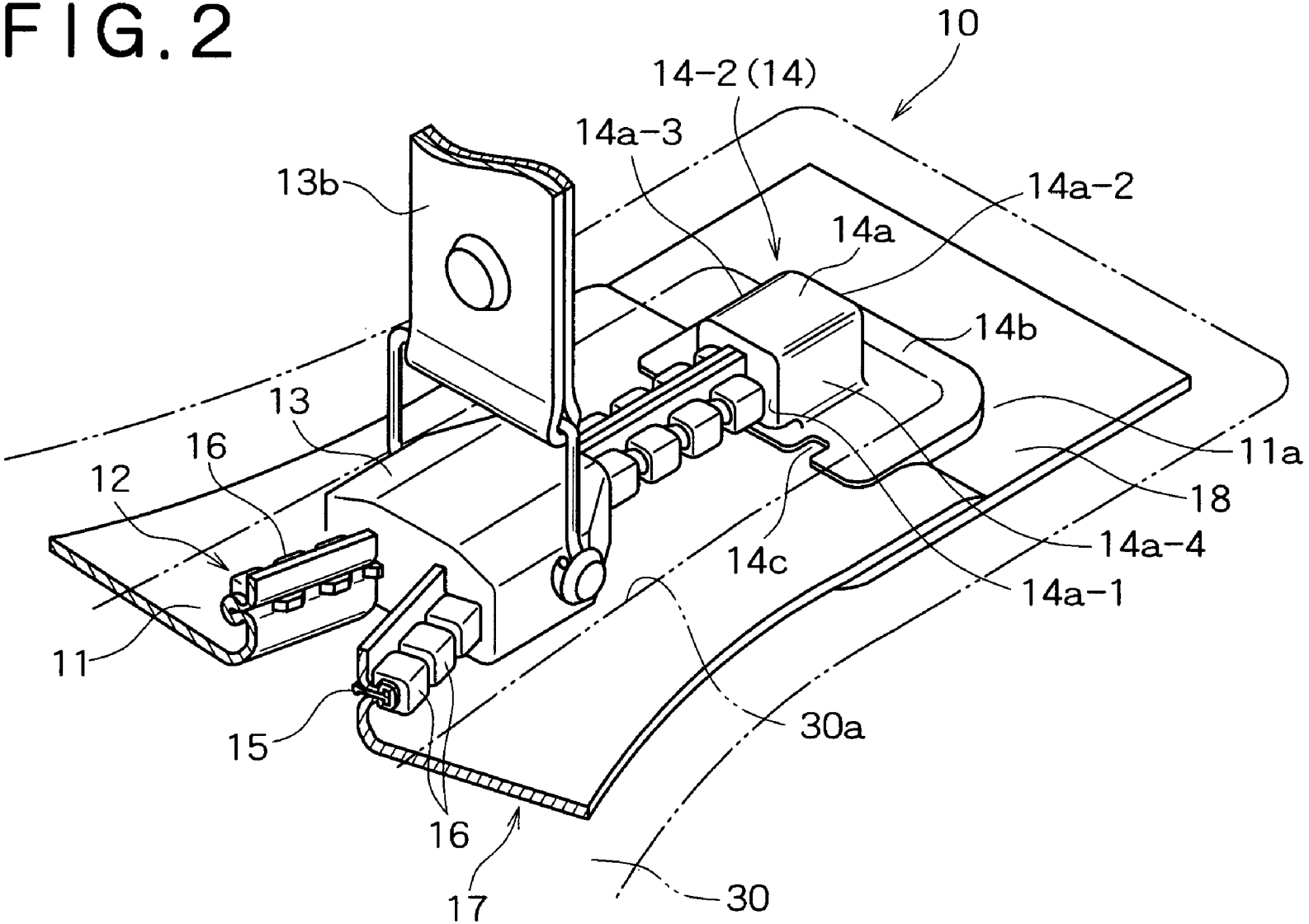
FIG. 2 is a perspective view of a lower end stop for the air/water-tight slide fastener of FIG. 1.

As shown in FIGS. 1 and 2, the air/water-tight slide fastener 10 is comprised of a pair of air/water-tight fastener tapes 11 and respective rows of fastener elements 12, a slider 13, and a upper and lower end stops 14-1, 14-2, just as the conventional slide fastener of this type. The air/water-tight tapes 11 are made of either a rubber or synthetic resinous sheet, or a woven fabric coated with watertight materials such as rubber or elastomer resins. Each air/water-tight fastener tape 11 has a longitudinal marginal edge portion folded back thereupon to thus provide a longitudinal folded edge portion. A multiplicity of fastener elements 12 are attached to the longitudinal folded edge portion of the air/water-tight fastener tape 11 at uniform interval.

As shown in FIGS. 1 and 2, each fastener element 12 is comprised of two separate elements, namely one is a coupling element 15 and the other is a clamping element 16.

According to this invention, alternatively, the fastener element 12 may be comprised of a coupling element 15 and a clamping element 16 both of which are integrally formed with each other. However, in the fastener element 12 comprised of two separate elements, part of the shape of the coupling element 16 is different that in the fastener element 12 comprised of a coupling element 15 and a clamping element 16 integrally formed with each other.

Figure 3:
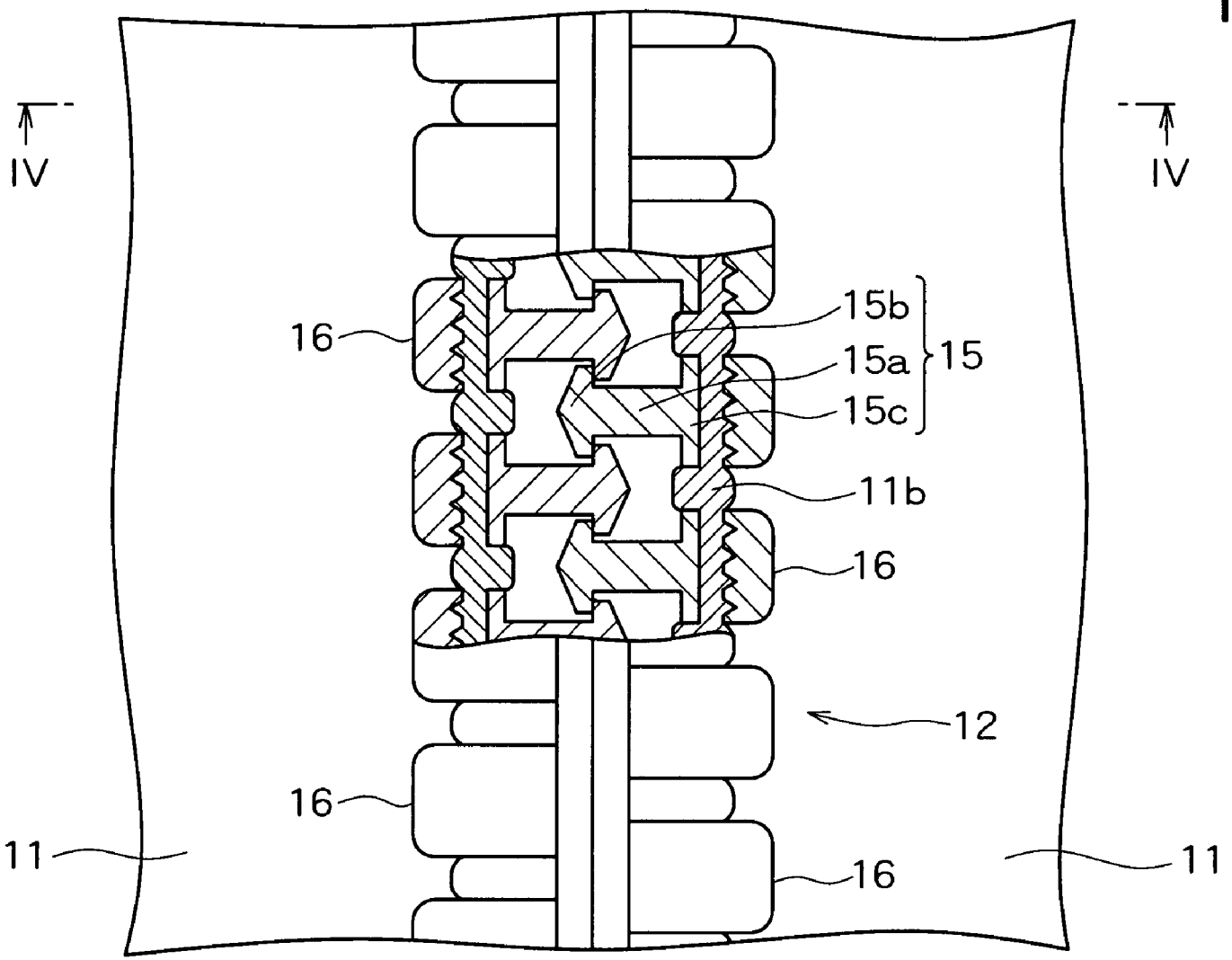
FIG. 3 is a partly-cut-out enlarged plan view showing two opposed rows of fastener elements of the slide fastener coupled with each other.
Figure 4:
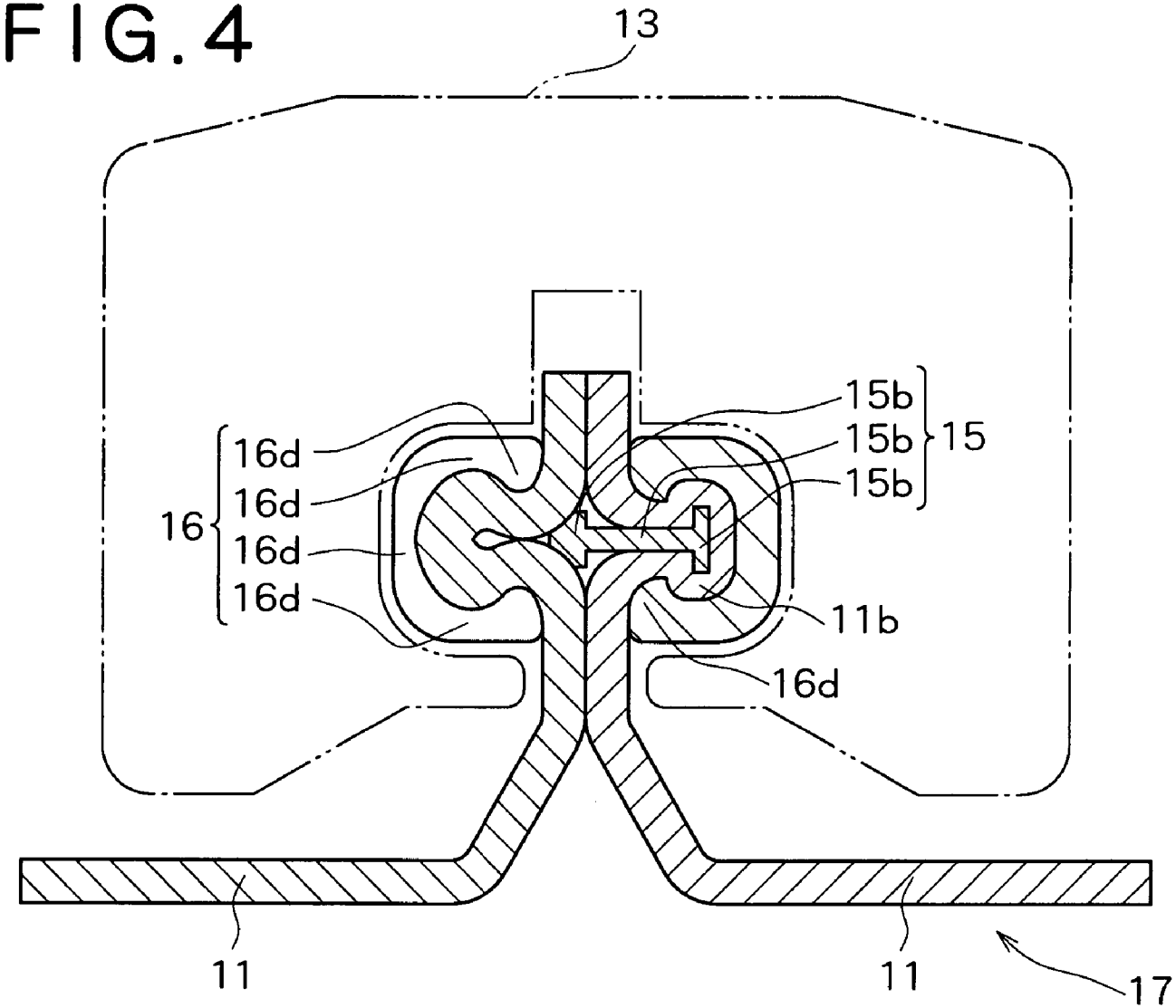
FIG. 4 is a cross-sectional view taken as viewed in the directions indicated by arrows IV in FIG. 3.

FIG. 3 is an enlarged plan view of part of the air/watertight slide fastener 10 with the fastener elements 12 held in coupled disposition, some coupling elements cut out. FIG. 4 is a cross-sectional view as viewed in the direction indicated by two arrows IV, IV in FIG. 3. In FIGS. 3 and 4, the coupling element 15 comprises a rectangular shaft 15*a*, a coupling head 15*b* provided on one end of the rectangular shaft 15*a* and cross-sectioned like an arrowhead and a rectangular flange 15*c* provided on the other end of the rectangular shaft 15*a*. As better shown in FIG. 4, the longitudinal edge portion of the air/water-tight fastener tape 11 is folded back around the flange 15*c* of the coupling element 15 with the terminal edge and the body of the fastener tape 11 spread apart in opposite direction to each other, to thus provide a substantially Ω-shaped element-retaining portion 11*b*. The Ω-shaped element-retaining portion 11*b* of the air/water-tight fastener tape 11 retentively wraps or envelopes the coupling element 15, with the coupling head 15*b* protruded outwardly.

As mentioned above, the longitudinal edge portion of the fastener tape 11 is folded back and wrapped around the flange 15*c* and the rectangular shaft 15*a* of the coupling element 15 to thus provide the element-retaining portion 11*b*. Then, as shown in FIG. 4, the clamping element 16 is forced to bend and clamp the element-retaining portion 11*b* with the flange 15*c* and the rectangular shaft 15*a* of the coupling element 15 enveloped therein so that the plurality of fastener elements 12 may be mounted firmly on the longitudinal folded edge of the air/water-tight tape 11 at uniform intervals. In order to wrap the longitudinal edge of the air/watertight tape 11 therearound, a multiplicity of coupling elements 12 are arranged beforehand along the longitudinal edge of the air/water-tight fastener tape 11 at uniform intervals. On the other hand, the U-shaped resilient clamping element 16 comprises a pair of opposed clamping arms 16*a*, 16*b* and a connecting portion 16*c* integrally connecting the clamping arms 16*a*, 16*b* and the opposed clamping arms 16*a*, 16*b* are converted remote from the connecting portion 16*c*.

The clamping arms 16*a*, 16*b* have a pair of upper and lower lips 16*d*, 16*d* provided at the respective distal ends thereof so as to protrude toward each other. The inner surface of the clamping element 16 including the lips 16*d* has a plurality of rectilinear grooves extending in the direction of the clamping element 16 being bent. The clamping element 16 is thus forced to bend and clamp the element-retaining portion 11*b* of the fastener tape 11 with the flange 15*c* and the rectangular shaft 15*a* of the coupling element 15 enveloped therein, in other words, the flange 15*c* and the rectangular shaft 15*a* are wrapped by the longitudinal edge of the tape 11 with the coupling head 15*b* projecting outwardly from the longitudinal edge of the tape 11, and then clamped by the U-shaped clamping element 16 with the wrapping longitudinal tape edge interposed therebetween, so that the plurality of fastener elements 12 are mounted firmly on the longitudinal folded edge of the air/water-tight tape 11 at uniform intervals, to thus provide fastener stringers 17. Then, a slider 13 is inserted through the pair of fastener stringers 17 of a predetermined length. An upper end stop 14-1 is mounted on one end of the fastener stringers 17 and a lower end stop 14-2 is mounted on the other end thereof, to thus provide an air/water-tight slide fastener 10.

As shown in FIGS. 1 and 2, the slider 13 is of polygonal shape and comprise an upper wing and a lower wing, and a peripheral portion connecting the upper and lower wing. The slider 13 is made of the same kinds of thermoplastic resins as the air/water-tight fastener tape 11. The slider 13 has a Y-shaped channel formed therethrough to let some fastener elements 12 pass therethrough to bring the coupling elements 12 of both coupling element rows into and out of engagement with each other. An inlet of the Y-shaped channel is denoted by the reference numeral 13*a*. A pull tab 13*b* is pivotally mounted on the opposed positions on the peripheral portion of the slider 13. The slider 13 is reciprocally movable along the rows of fastener elements 12 around the clamping elements 16 to bring the coupling elements 15 into and out of engagement with each other.

Figure 9:
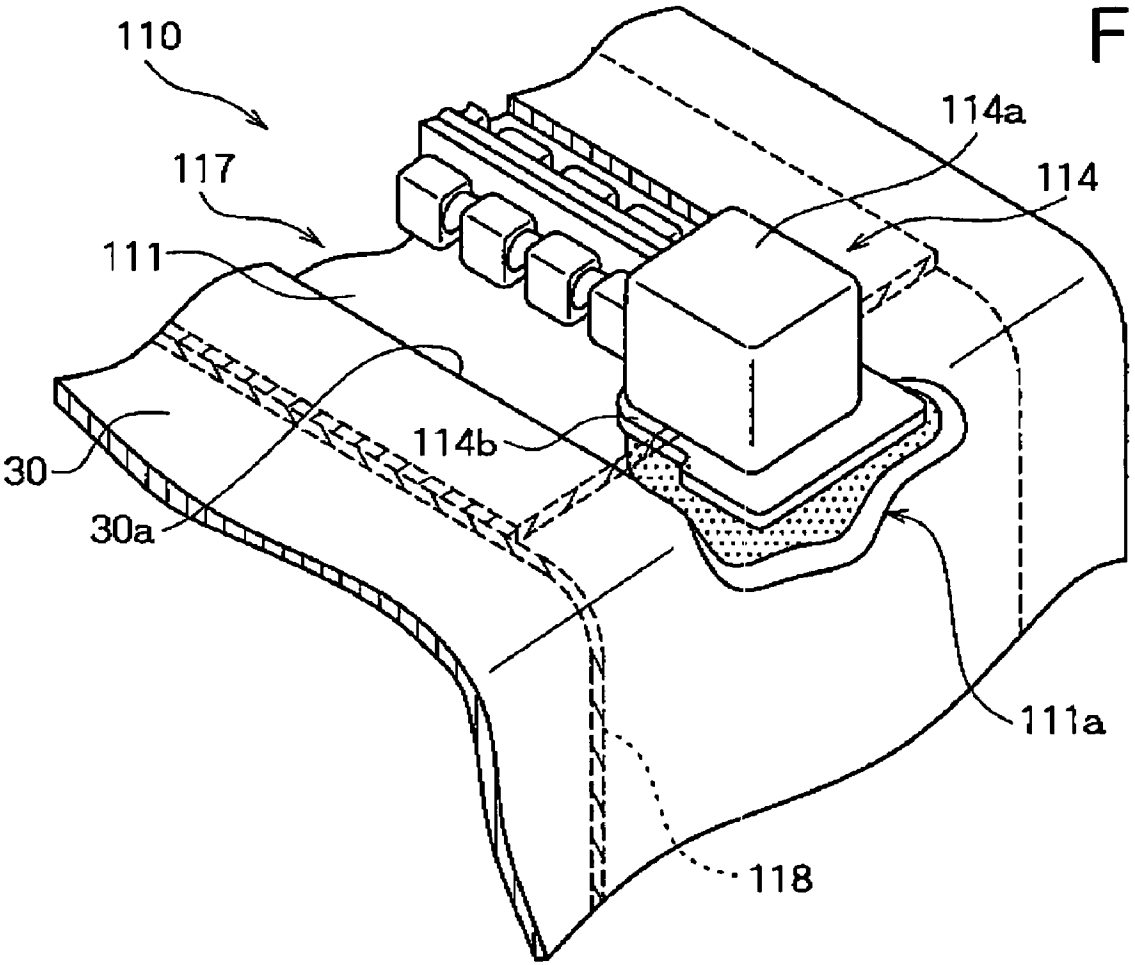
FIG. 9 PRIOR ART
FIG. 9 is an explanatory view showing a conventional air/water-tight slide fastener in folded disposition.

The construction of the air/water-tight slide fastener mentioned hereinabove is substantially identical with that of the conventional slide fastener except for that of the end stops 14 such as the upper end stop 14-1 and the lower end stop 14-2. Therefore, the present invention should not be limited to the embodiments shown in the drawings appended hereto, of course. As shown in FIG. 9, the conventional end stop 114 is a block 114*a* shaped like a substantially cubic body and made of synthetic resin. The block 114*a* includes an upper side, lower side and a pair of opposed first and second lateral sides. A narrow and thinned flange portion 114*b* is formed integrally around the lower edge of the block 114*a*. The flange portion 114*b* is intimately attached to the front sides of the air/water-tight fastener tape 111 and the backing patch 118 which is in turn integrally attached to the rear surface of one end of the fastener tapes 111.

Conversely, the end stop 14 according to the present invention has for its primary object to provide an air/water-tight slide fastener 10, which, in addition to the air/water-tight performance and durability, prevents part of air/water-tight fastener tape 11 from being peeled off when the tape 11 is forcibly folded along the length of the air/water-tight fastener 10. As better shown in FIGS. 5 and 6, the opposed edges 30*a* of the opening formed in the article 30 overlie the flange portion 14*b* of the end stop 14 The flange portion 14*b* of the end stop 14 which is the characteristic feature of the present invention has an area extensive enough to be intimately fixed to the opposed edges 30*a* of the opening of the article 30 indicated by a chain-dotted line in FIG. 1. The flange portion 14*b* continuously extends over the lower side 14*a*-2 and a pair of first and second lateral sides 14*a*-3, 14*a*-4 of the block 14*a*.

If the conventional air/water-tight slide fastener 110 shown in FIG. 9 is folded along the length of the air/water-tight tape 111, the slide fastener 110 rotates on the boundary between the block 114*a* and the flange portion 114*b* of the end stop 114, so that the part 111*a* of the air/water-tight tape 111 which lies on lower edge of the flange portion 114*b* bends abruptly longitudinally of the fastener tape 11. At this moment, that part 111*a* of the air/water-tight tape 111 is directly subjected to extremely strong bending stress against resiliency of the flange 114*b*, so that the air/water-tight fastener tape 111 is about to peel off the flange portion 114*b* from its corners.

Conversely, as shown in FIGS. 1 and 2, in the end stop 14 according to the present embodiment, a plate-like flange portion 14*b* is formed integrally and continuously around all the sides 14*a*-2, 14*a*-3, 14*a*-4 of the block 14*a* so as to extend widely outward therefrom except that side 14*a*-1 against which the slider is to abut. This construction provides an increased area over which and hence an increased force by which the end stop 14 is attached to the air/water-tight fastener tape 11. Furthermore, the opening edge 30*a* of the article 30 is placed on and integrally welded to the flange portion 14*b* and the air/water-tight tape 11 so that the flange portion 14*b* and the air-tight tape 11 are attached to each other more strongly.

The end stop 14 is integrally mounted on one end of the fastener stringers 17, specificallly it is integrally fixed, through injection mold process, to the front side of the air/water-tight tape 11 and the backing patch 18 which forms part of the tape 11, across the boundary therebetween. Therefore, the top stop 14 is preferably made from elastic thermoplastic resin of the same type as the elastic thermoplastic resin from which the air/water-tight tape 11 and the backing patch 18 are made, and more preferably is made from flexible polyurethane or polyvinyl chloride resin.

Figure 5:
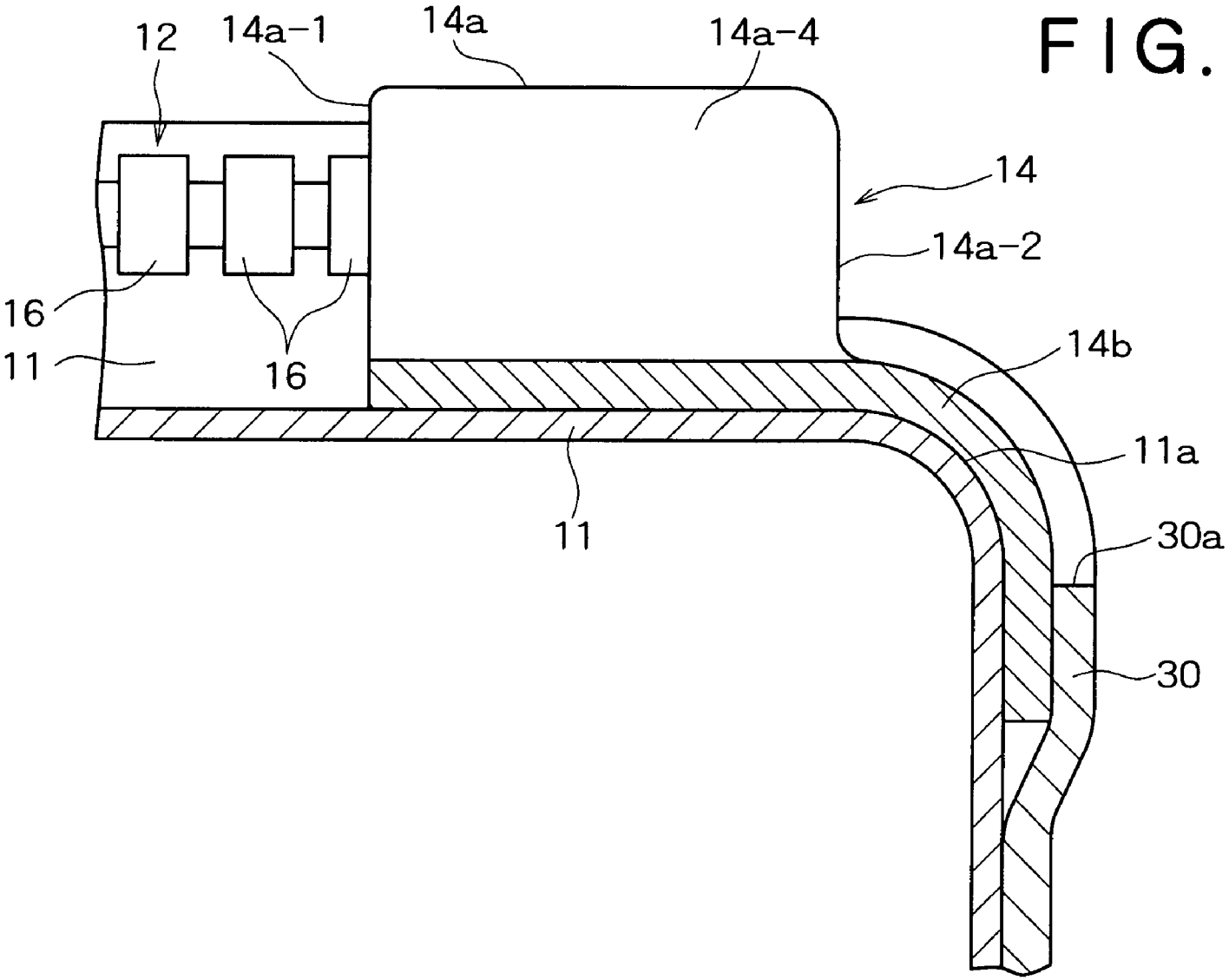
FIG. 5 is an explanatory view showing the slide fastener bent downwards.

FIG. 5 shows the air/water-tight slide fastener 10 folded down. In the illustrated air/water-tight slide fastener 10, the flange portion 14*b* of the end stop 14 is firmly clamped by and between the air/water-tight tape 11 and the opening edges 30*a* of the article 30. Furthermore, the air-tight tape 11 and the article 30 are directly and integrally welded to each other by the lower edge of the flange portion 14*b* so that the part 11*a* of the air/water-tight 11 is retained to the article 30 more firmly.

Consequently, when the air/water-tight slide fastener 10 is folded, as shown in FIG. 5, the air/water-tight slide fastener 10 bends gently or arcuately around the boundary between the block 14*a* and the flange portion 14*b* of the end stop 14. At this moment, the opening edge 30*a* of the article 30 functions to restrain the resilience of the flange portion 14*b* as mentioned above, so that the bending stress of the flange portion 14*b* is relaxed and the excessive bending stress to which the air/water-tight fastener tape 11 is subjected is restrained. As a result, there is generated no strong bending stresses tending to largely stretch that part 11*a* of the air/water-tight fastener tape 11 lying in the lower edge of the flange portion 14*b*, so that the tape part 11*a* will never be peeled off.

Furthermore, the flange 14*b* are chamfered at its four corners or provided there with arcuate surfaces. In addition, the flange portion 14*b* has a pair of notches 14*c*, 14*c* formed in the upper edge thereof. Since the four corners of the flange 14*b* are chamfered; however strongly the edges 30*a* of the opening of the article 30 may be pressed against the air/water-tight slide fastener 10 when the air/water-tight slide fastener 10 is folded, part of pulling stresses arising in that part 11*a* of the fastener tape 11 which lies in the lower edge of the flange portion 14*b* is relieved by the chamfered corners, so that that part 11*a* of the fastener tape 11 which lies in the lower edge of the flange portion 14*b* is prevented from being peeled or broken. Furthermore, the notches 14*c*, 14*c* formed in the upper edge of the flange portion 14*b* are helpful in enhancing the flexibility of the flange portion 14*b*.

Figure 6:
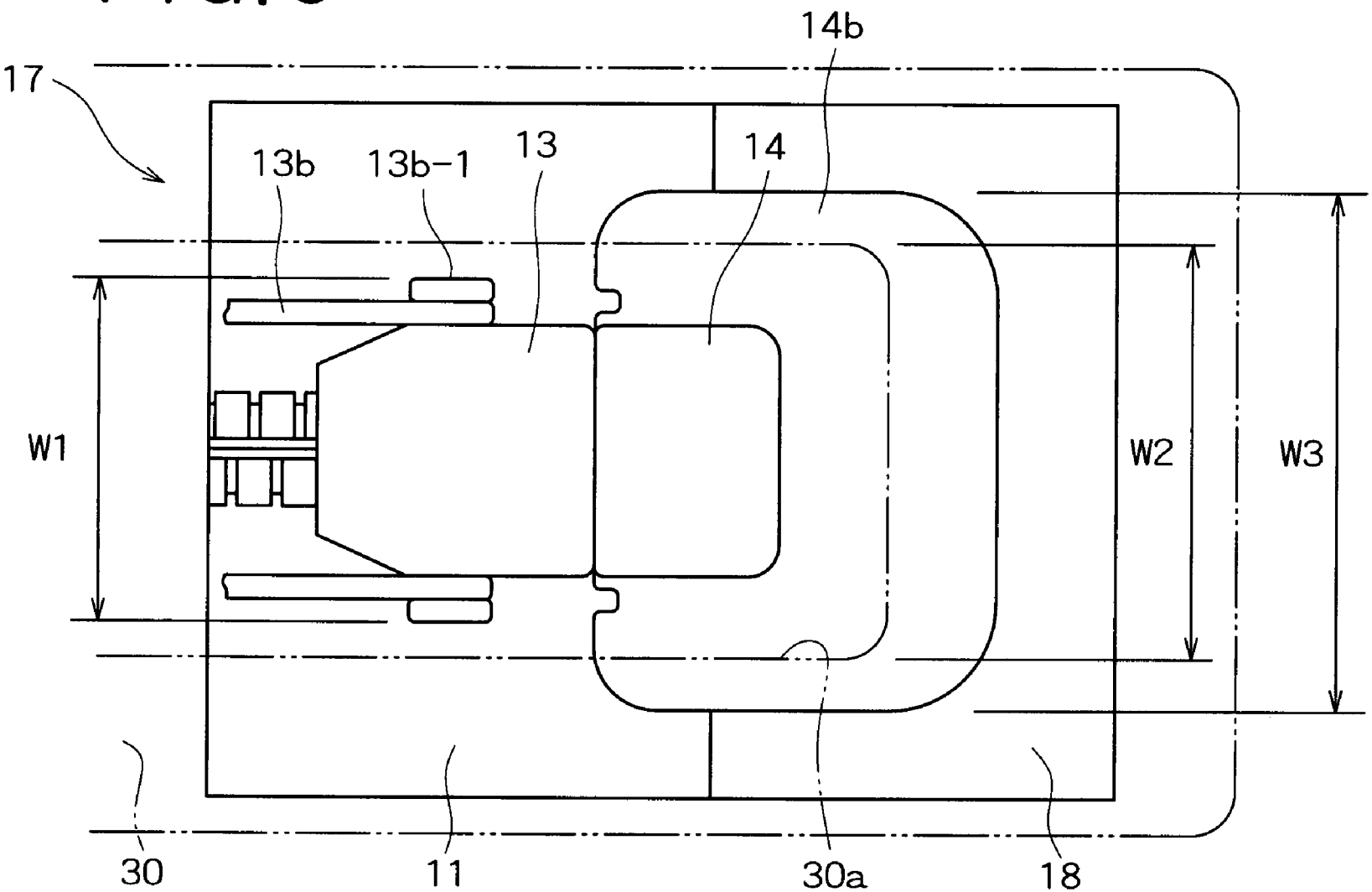
FIG. 6 is an explanatory view showing the relationship between the maximum width W1 of the slider and the width of the opening formed in an article.

FIG. 6 shows the relationship between the maximum width W1 of the slider 13 and the opening width W2 formed between the opening edges 30*a* of the article 30. In FIG. 6, the maximum width W1 of the slider 13 is the distance between the opposed ends of the pintles 13*b*-1 of the pull tab which are rotatably mounted on the opposed sides of the slider 13. Preferably, the maximum width W1 of the slider 13 is set to be less than the opening width W2 defined between the opening edges 30*a* of the opening formed in the article 30. The width W3 of the flange portion 14*b* is preferably set to be greater than the maximum width W1 of the slider 13. In addition, FIG. 6 shows that the width W3 of the flange portion 14*b* is set to be greater than the opening width W2 defined between the opposed edges 30*a* of the opening formed in the article 30.

The width W3 of the flange portion 14*b*, although having no specific limitation, should preferably be between 25 mm and 30 mm. It is essential to set the thickness of the flange portion 14*b* to be 1.2 mm or more when molding the flange portion 14*b* having such width W3, in order to permit smooth filling of a mold with resin. In accordance with the present embodiment, the thickness of the flange portion 14*b* is set to be 1.5 mm.

If the width W3 of the flange portion 14*b* is set to be less than the maximum width W1 of the slider 13, and the maximum width W1 of the slider 13 is excessively close to the opening width W2 of the article 30, it necessarily follows that the opening edges 30*a* of the article 30 attached to the upper surface of the flange portion 14*b* come close to the side of the fastener elements 12. If manipulating the slider 13 under this condition, part of the air/water-tight fastener tape 11 has become stiff. The fastener tape 11 will not elastically deform as the fastener elements 12 are coupled. As a result, smooth coupling of fastener elements 12 disadvantageously fails.

If the flange portion 14*b*, the air/water-tight fastener tape 11 and the article 30 are unified as described above in such a relation that the width W3 of the flange portion 14*b* be between 25 mm and 30 mm, the thickness of the flange portion 14*b* be set to be 1.5 mm and the maximum width W1 of the slider 13 be less than the opening width W2 of the article 30, the air/water-tight fastener tape 11 can enjoy sufficient flexibility, which facilitates the smooth operation of the slider 13.

Figure 7:
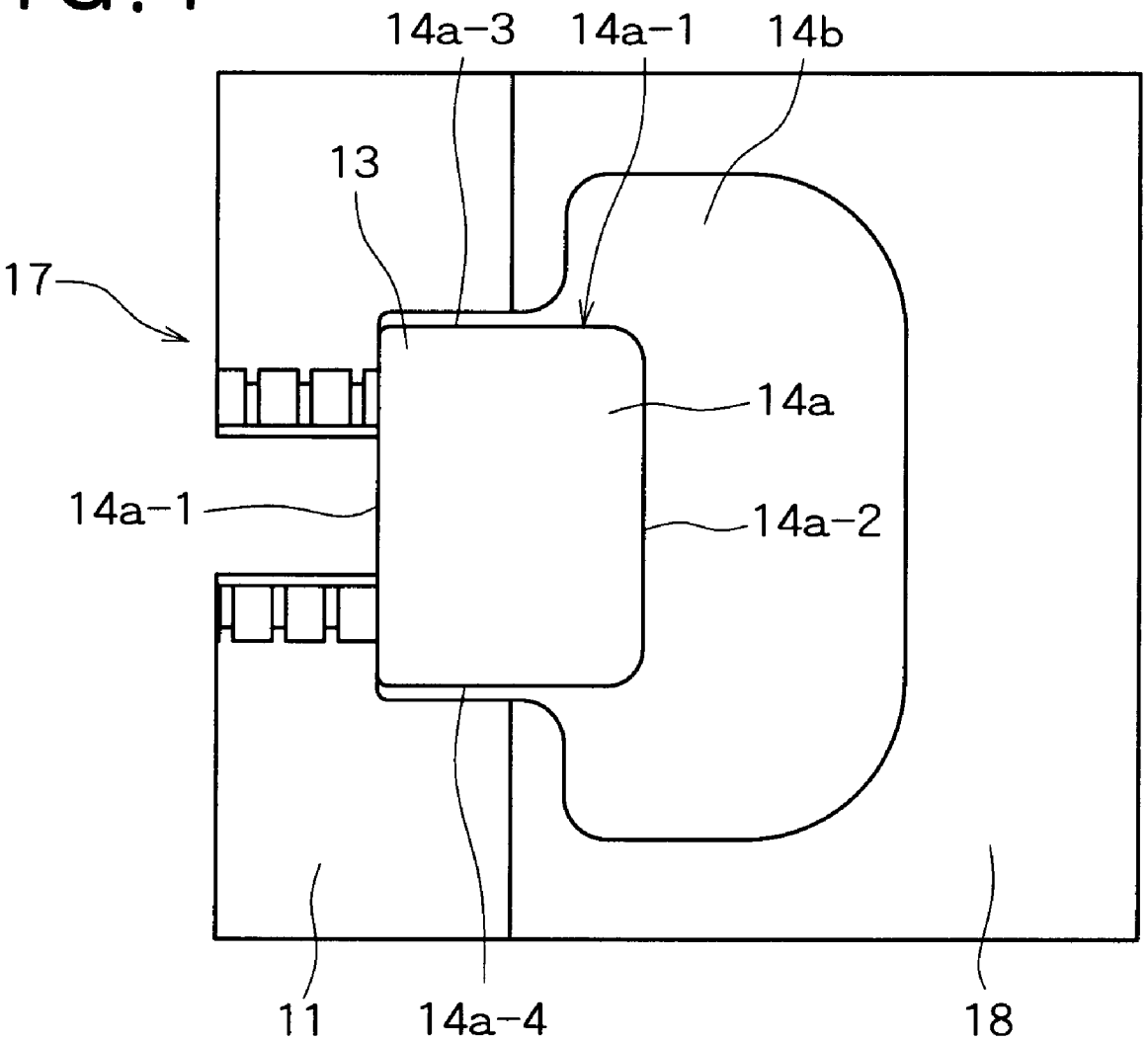
FIG. 7 is an enlarged plan view showing an essential part of a modification of an end stop.

FIG. 7 shows a modification of an end stop of the air/water-tight slide fastener 10. In this end stop, the flange portion 14*b* extends outwardly from all the sides of the block 14*a* except the upper side 14*a*-1 against which the slider abuts, that is, the three sides 14*a*-2, 14*a*-3, 14*a*-4. The flange portion 14*b* is formed continuously. It is not necessarily necessary that there are flanges formed entirely over the three sides of the block 14*b*. As shown in FIG. 7, the flange portion 14*b* may extend along only part of each of the opposed first and second lateral sides 14*a*-3, 14*a*-4 of the block 14*a*.

According to the present invention, the shape of the end stop 14 is not limited. For example, the end stop 14 may be of cubic, parallelepiped, cylindrical or any multigonal prisms as long as the end stop 14 includes a front side, a rear side and lateral sides 14*a*-1, 14*a*-2, 14*a*-3, 14*a*-4 connecting the front and rear side. The position where the flange portion 14*b* is formed may be determined suitably depending on the length and width of the air/water-tight slide fastener 10, the materials of the air/water-tight fastener tape 11, the size of the clamping element 16, the shape, size, construction, material of the end stop 14, etc., so that, when the air/water-tight slide fastener 10 is folded in the direction of the length of the slide fastener 10, that part 11*a* of the air/water-tight fastener tape 11 lying in the lower edge of the flange portion 14*b* may be prevented from being peeled off.

CONCLUSIONS, RAMIFICATIONS, AND SCOPE OF THE INVENTION

Figure 8:
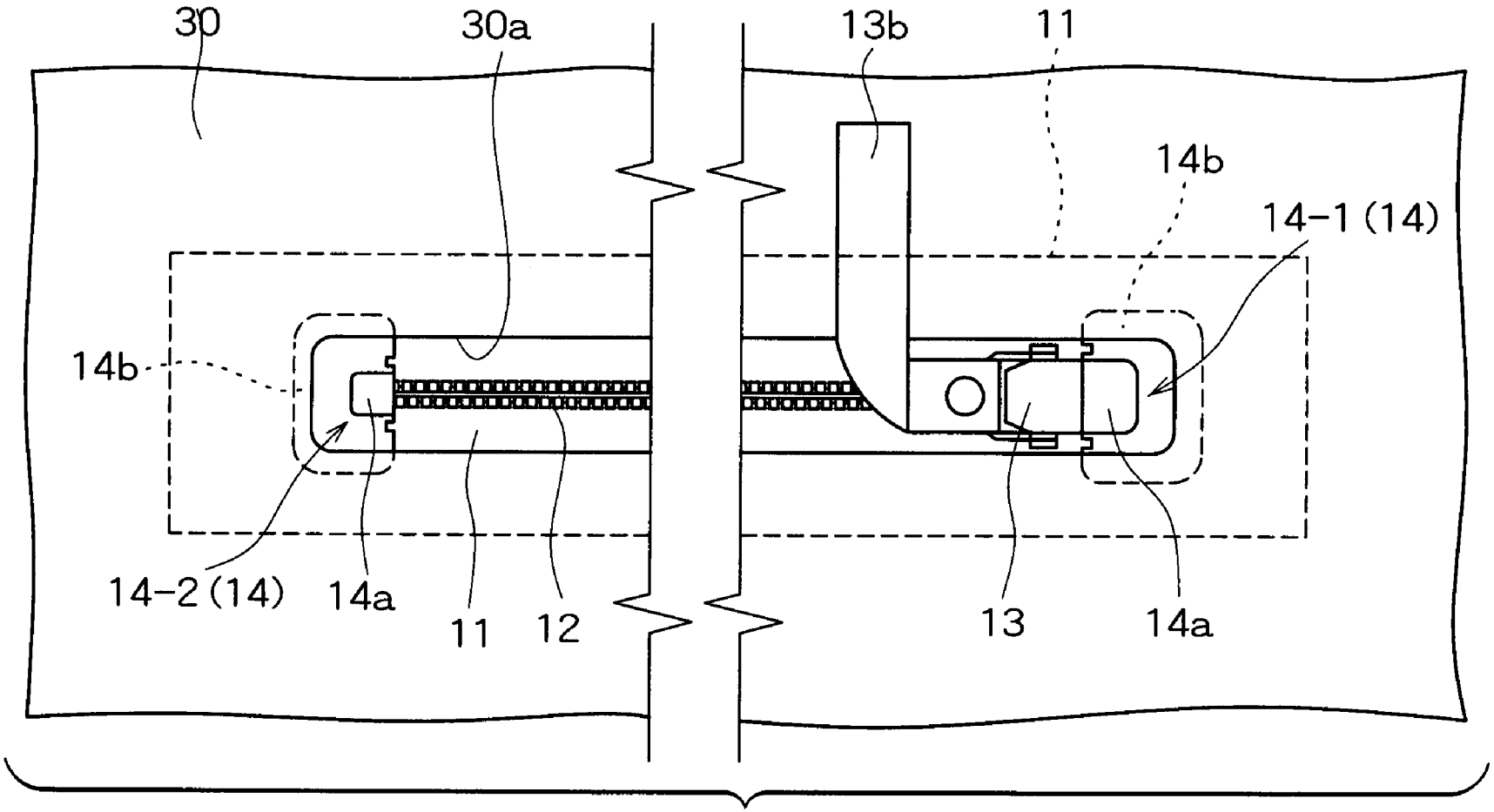
FIG. 8 is a fragmentary plan view showing how the slide fastener is attached to an article.

The air/water-tight slide fastener 10 according to the present invention can be conveniently used for various articles such as flexible container for transportation of liquids, protective suits, diving suits etc. FIG. 8 is a plan view which examplarily shows how the air/water-tight slide fastener 11 according to the present invention is attached at both ends to the article 30.

In FIG. 8, it is not by sewing but by high-frequency welding or supersonic welding that the air/water-tight slide fastener 10 should be attached to the article 30 while securing high air/water-tightness. In this event, the greater affinity thermoplastic resins for the slide fastener 10 and the article 30 have for each other, the more strongly the resins are welded thereto. Therefore, it is naturally desirable to use the same type of thermoplastic resins for both the article 30 and the air/water-tight slide fastener 10. It is desirable to use polyurethane resin as coating materials for the air/water-tight tape 11 and polyurethane resin as resinous materials for coating a fabric-reinforcing layer constituting the article 30. According to the present invention, the coating material for the air/water-tight fastener tape 11 and the coating material for the fabric-reinforcing layer are not limited to polyurethane resin, and as such coating materials, other thermoplastic synthetic resinous materials mentioned above may be used.

The air/water-tight slide fastener 10 has an area extensive enough that the flange portion 14*b* of the end stop 14 can be intimately attached or fixed to the opening edges 30*a* of the article 30 attached to the air/water-tight fastener tape 11. With this construction, as shown in FIG. 8, the opening edges 30*a* of the article 30 are intimately joined with the front surfaces of the flange portion 14*b* of the end stop 14 and the air/water-tight fastener tape 11 while being separated a predetermined distance from the clamping elements 16 and the slider 13, through high frequency welding or supersonic welding method. Consequently, the article 30 can enjoy adequate air/water-tight performance.

The above description has been made of some preferred embodiments of the present invention. However, the present invention need not be limited to the those embodiments. For example, it is not necessary to provide the flanges 14*b* around all the sides 14*a*-1, 14*a*-2, 14*a*-3, 14*a*-4 of the block 14*a* of the end stop 14. For accomplishing the purposes of this invention, the position, shape, size, etc. of the flange portion 14*b* can be set suitably depending on other factors, such as the length and width of the air/water-tight slide fastener 10 and the materials of the air/water-tight fastener tape 11, the size of the clamping element 16, the shape, size, construction and materials of the end stop 14. Accordingly, the present invention is not limited to the above-mentioned embodiments and modifications, but may be modified and improved in various ways as long as it falls within the scope of the claims appended hereto.

While the above description contains many specificities, these should not be construed as limitations on the scope of the invention, but rather as an exemplification of one preferred embodiment thereof. Many other variations are possible. Accordingly, the scope of the invention should be determined not by the embodiments illustrated, but by the appended claims and their legal equivalents.

What is claimed is:

1. An air/water-right slide fastener for opening and closing an opening formed in an article comprising:

a pair of fastener swingers each including an air/water-tight tape and a plurality of fastener elements mounted on one longitudinal edge thereof, each fastener element including a coupling element having a shaft and a coupling head provided on one end of the shaft, and a substantially U-shaped clamping element, the shaft being wrapped by the longitudinal edge of the tape with the coupling head projecting outwardly from the longitudinal edge of the tape, and then clamped by the U-shaped clamping element with the wrapping longitudinal tape edge interposed therebetween, the fastener tapes being mounted along the opposed edges of the opening on the rear side of the article;

a slider reciprocally movable along the fastener elements around the clamping elements to bring the coupling elements into and out of engagement with each other; and an end stop integrally mounted on one end of the fastener stringers to stop the movement of the slider, the end stop including a block and a flange portion extending round the block and intimately fixed to the front side of the air/water-tight tape, at least part of the flange portion be extensive enough to be integrally fixed to the opening edges of the article.

2. An air/water-tight slide fastener recited in claim 1, wherein the flange portion is made of flexible materials.

3. An air/water-right slide fastener recited in claim 1, wherein the flange portion continuously extends over the lower side and a pair of first and second lateral sides of the block.

4. An air/water-tight slide fastener recited in claim 1, wherein the maximum width W1 of the slider is set to be less than the opening width W2 defined between the opening edges.

5. An air/water-tight slide fastener recited in claim 1 wherein the width W3 of the flange portion is greater than the maximum width W1 of the slider.

6. An air/water-tight slide fastener recited in claim 1, wherein the width W3 of the flange portion is greater than the opening width W2 defined between the opposed edges of the opening formed in the article.

* * * * *